US007474224B2

(12) United States Patent
Long et al.

(10) Patent No.: US 7,474,224 B2
(45) Date of Patent: Jan. 6, 2009

(54) PATIENT MONITOR WITH MAGNETIC DISARMING CIRCUIT

(75) Inventors: Timothy G. Long, Petaluma, CA (US); Steven Alfred Williams, Hong Kong (CN)

(73) Assignee: Smart Caregiver Corporation, Petaluma, CA (US)

( * ) Notice: Subject to any disclaimer, the term of this patent is extended or adjusted under 35 U.S.C. 154(b) by 377 days.

(21) Appl. No.: 11/223,412

(22) Filed: Sep. 8, 2005

(65) Prior Publication Data

US 2006/0055526 A1 Mar. 16, 2006

Related U.S. Application Data

(60) Provisional application No. 60/608,247, filed on Sep. 8, 2004.

(51) Int. Cl.
*G08B 23/00* (2006.01)

(52) U.S. Cl. ..... 340/573.1; 340/547

(58) Field of Classification Search ..... 340/573.1, 340/547, 5.6, 5.66; 307/414, 415; 200/19.36
See application file for complete search history.

(56) References Cited

U.S. PATENT DOCUMENTS 3,813,663 A * 5/1974 Perkins ..... 340/5.66
4,908,604 A * 3/1990 Jacob ..... 340/547
5,410,297 A * 4/1995 Joseph et al. ..... 340/573.7
5,654,694 A * 8/1997 Newham ..... 340/573.1
6,304,177 B1 * 10/2001 Nigro et al. ..... 340/547
6,310,549 B1 * 10/2001 Loftin et al. ..... 340/547

* cited by examiner

*Primary Examiner*—John A Tweel, Jr.
(74) *Attorney, Agent, or Firm*—Craig M. Stainbrook; Stainbrook & Stainbrook, LLP

(57) ABSTRACT

Provided is a patient monitoring device having a magnetic disarming circuit which allows for disarming of the alarm system only by authorized staff having a suitable magnetic disarming key.

1 Claim, 5 Drawing Sheets

PATIENT MONITOR WITH MAGNETIC DISARMING CIRCUIT

CROSS REFERENCE TO RELATED APPLICATIONS

The present application claims the benefit of the filing date of U.S. Provisional Patent Application Ser. No. 60/608,247, filed Sep. 8, 2004.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates generally to apparatus for monitoring patient movement, and more particularly to an anti-wandering monitoring and alarm device for alerting staff when a patient has moved outside a defined area, and still more particularly to such a device having a magnetic disarming circuit which allows for disarming of the alarm system only by authorized staff having a suitable magnetic disarming key.

BACKGROUND INFORMATION AND DISCUSSION OF RELATED ART

Residential care facilities, particularly long-term residential care nursing facilities, must provide a considerable measure of protection to residents who may be impaired in their ability to care for themselves or to exercise sound judgment. Inherent in such care is the need to routinely confine residents to beds, chairs, showers, or other defined spaces or support apparatus. Accordingly, it is known to provide bed, chair, shower, and room occupancy monitoring systems to alert staff or attendants of inappropriate patient movement or mishaps.

For example, U.S. Pat. No. 5,410,297 to Joseph teaches a bed monitoring system including a capacitive sensor pad for placement under a patient. The pad comprises a foam plastic pad and heavy aluminum foil plates laminated on opposite sides of the foam. The plates are then adhesively bonded to the inner surfaces of an outer cover. The capacitor of the pad is connected in circuit with an oscillator and produces a frequency-related output. A ripple counter establishes a frequency-related output proportional to the capacitance. A microprocessor reads the counter output and samples are averaged to establish a reference base and the true weight affect of the patient on the sensing pad. Other factors which might effect the signal are readily attended to by programmed compensation. Each subsequent sample is averaged and compared with the reference base. If within a permitted range, the latest and current signal is averaged with the reference base and establishes a new base, and continuously tracks changes in the sensing system. A selected change in a selected time delay system actuates an alert or alarm system, which requires positive resetting to terminate the alarm system. The system is positively reset to return to normal position monitoring. The system may be set to automatically reset the alarm system after an alarm condition is established and then removed by the continuous tracking of the patient movement.

Also illustrative of the art, U.S. Pat. No. 5,654,694 to Newham discloses a mobile patient monitoring system. The system includes a load sensor which detects the presence of a patient on a device and further includes a microprocessor responsive to a resident program. A first circuit connected to the microprocessor and to the sensor automatically activates operation of the microprocessor to a "monitor" mode upon detection by the sensor of the patient's presence on the device; it maintains operation of the microprocessor for a predetermined time period at least equal to a running time of the program; and it terminates operation of the microprocessor at the expiration of the predetermined time period after detection by the sensor of termination of the patient's presence on the device prior to expiration of the predetermined time period. A second circuit operates the system in response to commands manually applied to the second circuit to deactivate the system to a "hold/reset" mode after activating of the system to the "monitor" mode. The first circuit will also activate the system to the "monitor" mode after the system has been deactivated to the "hold/reset" mode together with subsequent detection by the sensor of termination of the patient's presence on the device and resumption of the patient's presence on the device. Alternatively, the microprocessor is responsive to the manually operable switch in the second circuit to activate the system to the "monitor" mode after the system has been deactivated to the "hold/reset" mode. A third circuit connected to the microprocessor provides an audio alarm upon demand by the microprocessor.

The present invention provides advantages over prior art systems in that the system sends either a wireless signal or an electrical signal over wire to a remote alarm or monitor (e.g., further than six feet from the bed, floor, chair, shower, or other patient area being monitored). The system may be always on, i.e., it may be a system having no on/off switch or circuit, and therefore always monitoring; or it may be a system selectively turned on or off manually by authorized personnel. When a patient is present and comprises a weight or load on a load sensor in a bed mat, floor mat, chair mat, or the like, the mat activates the alarm device (i.e., the monitor) to place it in the operating mode. Alternatively, the monitor can be placed in an operating mode manually. In either case, when the patient or care home resident moves off from the mat, an RF or electrical signal is sent to the monitor and an audible alarm is emitted. This alerts attendants that the individual being monitored has left the monitoring mat.

Current art teaches an alarm system that may be disarmed manually with a switch, thus permitting a patient with sufficient resolve and sophistication to disable the device and defeat effective monitoring. The present invention improves over the prior art by providing a system monitor that may be disabled only through the use of a magnetic key, adapted for use with a particular monitor, and employed by placing the key on a defined magnetic key surface area.

The foregoing patents and other referenes reflect the current state of the art of which the present inventor is aware. Reference to, and discussion of, these references is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

BRIEF SUMMARY OF THE INVENTION

It is therefore an object of the present invention to provide a new and improved patient monitoring device having a magnetic disarming circuit that enables disarming of the alarm system only by authorized staff having a suitable magnetic disarming key.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty that characterize the invention are pointed out with particularity in the claims annexed to and forming part of this disclosure. The invention does not reside in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
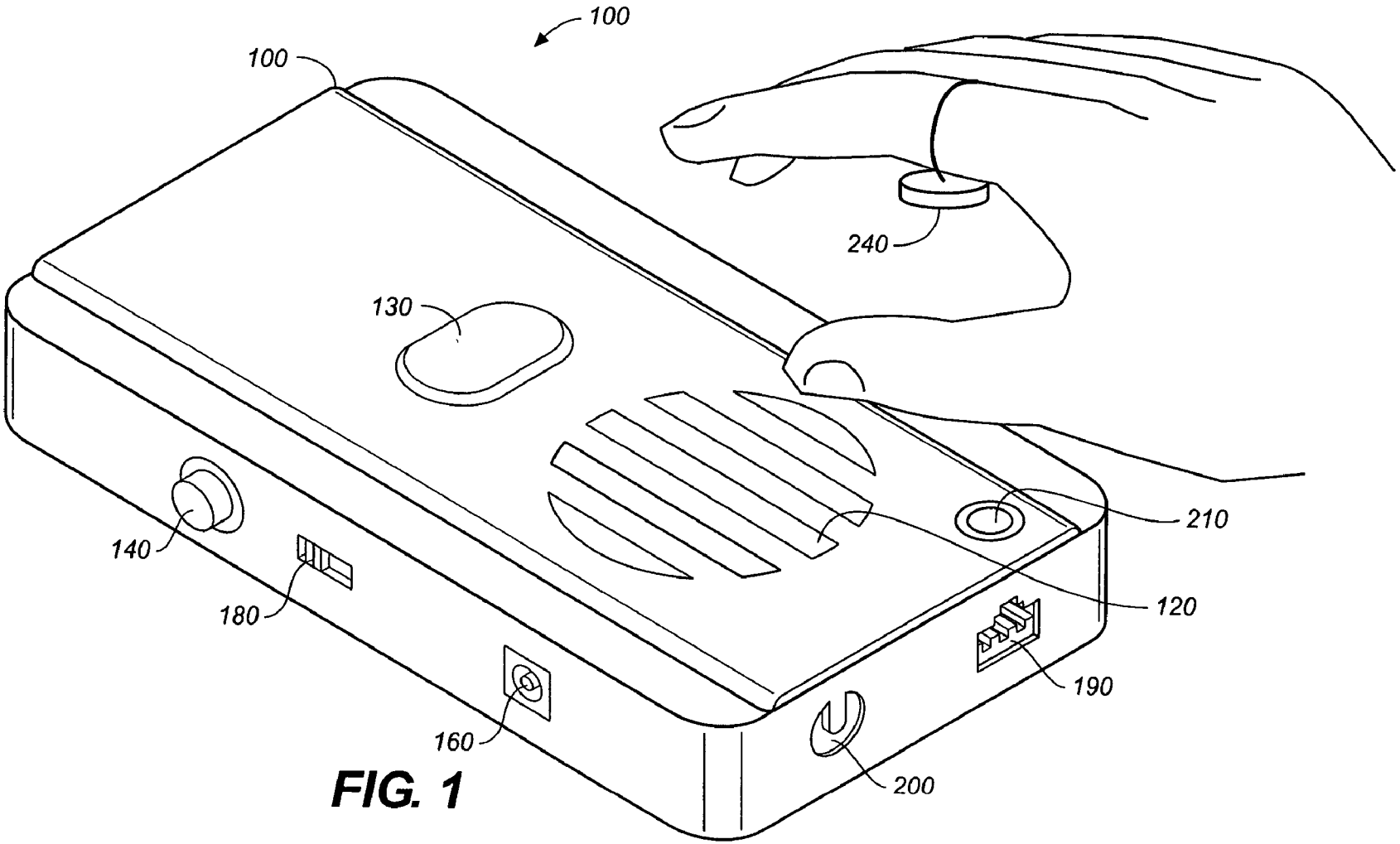
FIG. 1 is a perspective view of the alarm/monitor of the present invention, showing imminent use of the monitor's magnetic key.
Figure 2:
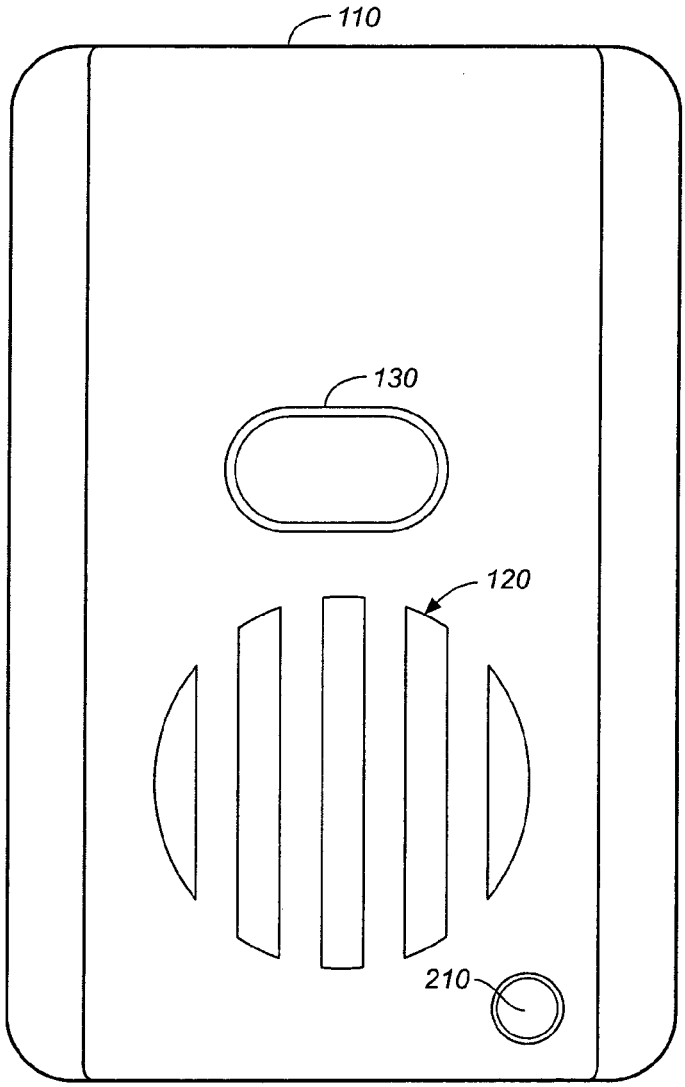
FIG. 2 is a front view in elevation showing the apparatus of FIG. 1.
Figure 3:
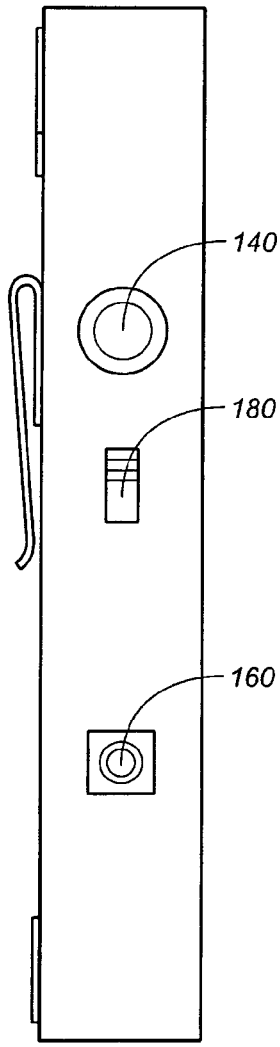
FIG. 3 is a side view in elevation of the apparatus of FIG. 1.
Figure 4:
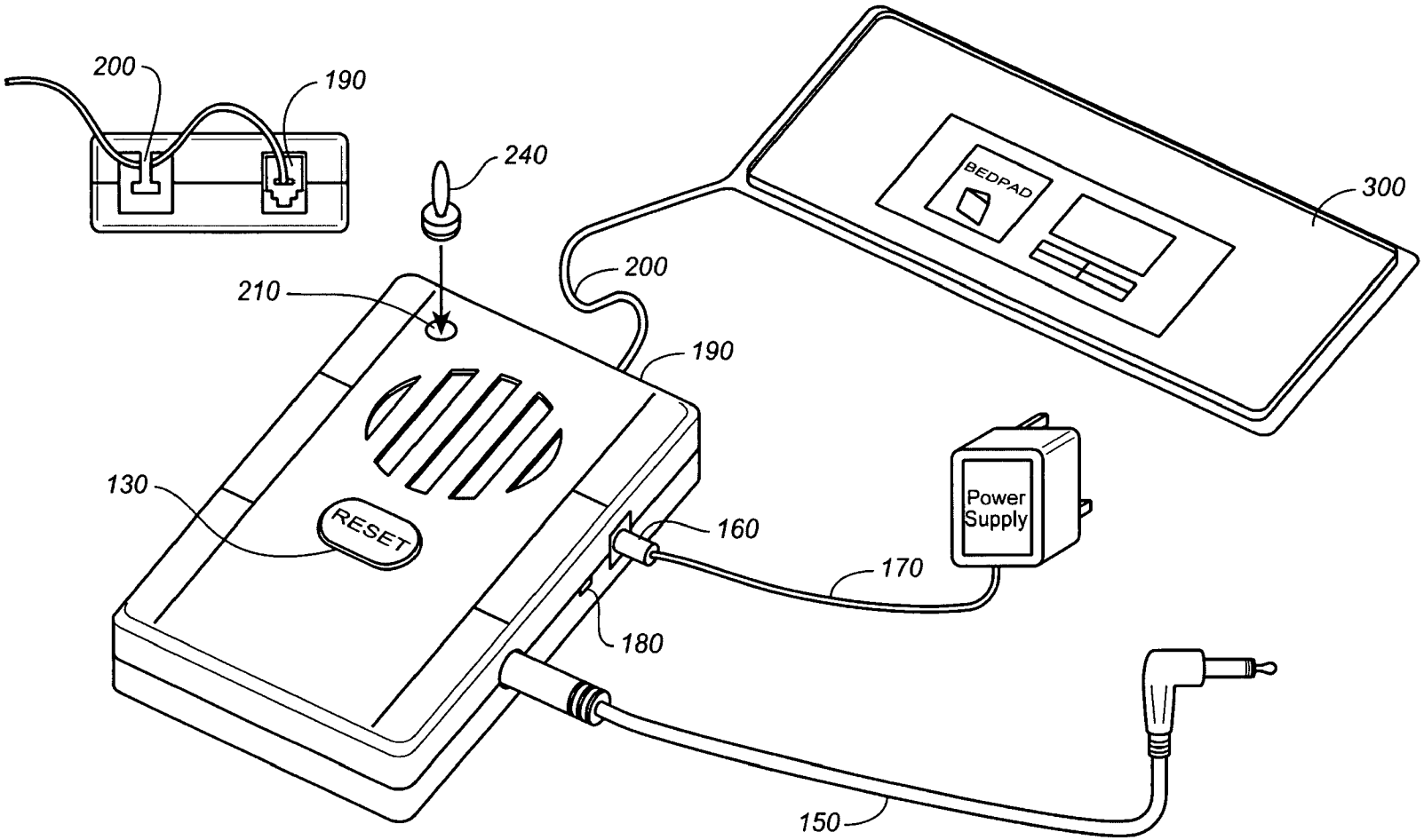
FIG. 4 is a schematic view showing the inventive monitor and the environment of its use.

Referring to FIGS. 1 through 5, wherein like reference numerals refer to like components in the various views, FIG. 1 is a perspective view of the alarm/monitor of the present invention, generally denominated 100. FIGS. 2 and 3 are front and side elevation views, respectively, while FIG. 4 is a schematic view showing the inventive monitor and the environment of its use.

Figures 5, 5A:
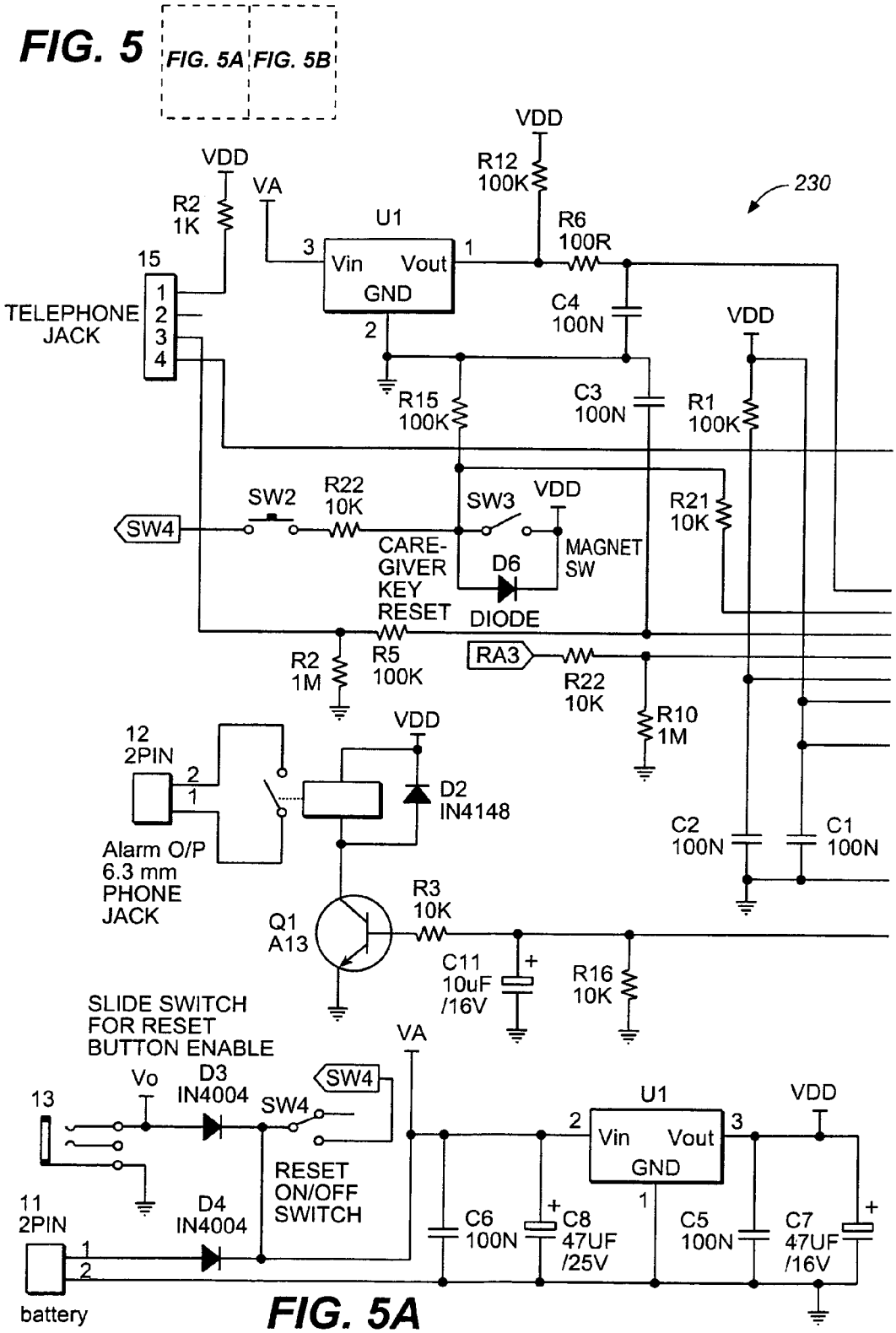
FIGS. 5A and 5B are wiring schematics showing the magnetic care giver reset switch.
Figure 5B:
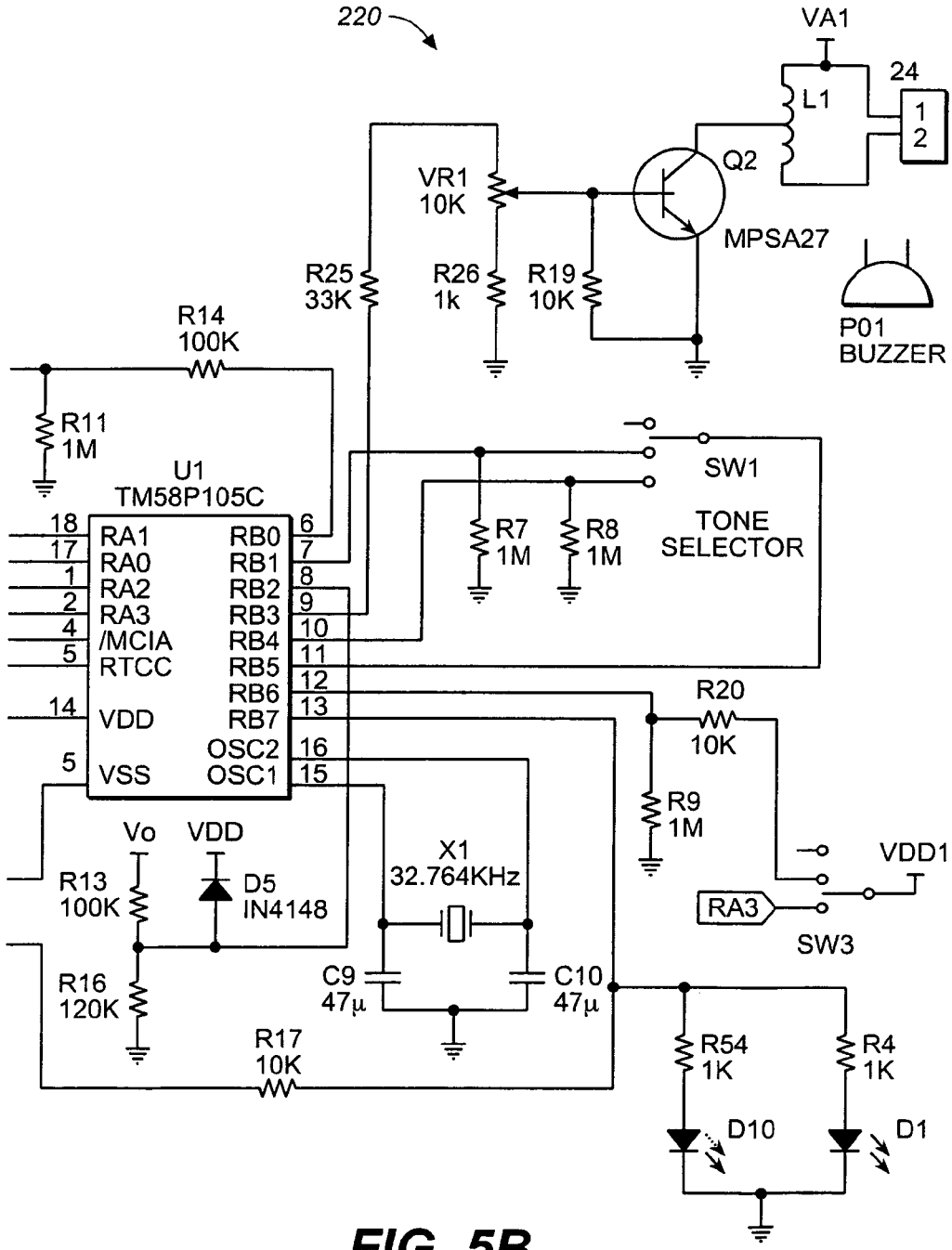

FIG. 5 is a wiring schematic showing the magnetic care giver reset switch.

These views show that the physical and functional components of the patient monitoring of the present invention include an alarm housing 110, having an alarm audio output or speaker 120, a visual light alarm indicator 130, a nurse call button 140 which may be optionally connected to a nurse call system (not shown) through a nurse call cable 150, a power adapter connector 160 for connection to a power supply through a power cord 170, a reset button 180, a sensor pad jack 190, a cord strain relief 200, and a magnetic key switch surface pad 210. In addition to enclosing the audio output device, the housing also encloses a circuit 220, which includes a magnetic key reset switch 230. This switch is activated and deactivated by a magnetic key 240, which is briefly placed on the magnetic key switch surface pad 210 when it is desired to disable to a sounding alarm or otherwise to reset the monitoring apparatus.

Referring now to the environment of its use, as shown in FIG. 4, the inventive monitor is employed in connection with a pressure pad 300 positioned on a bed, chair; floor, or other support surface. The pad is placed in RF communication or is connected by electrical cord to the monitor through a cord jack 190. The pad is thus in either wireless or wired electrical connection with the patient monitor. As is known in the art, the monitor is armed or enabled when a load (i.e., a patient) is placed on the sensor pad. The monitor is thereafter always on. When the resident or patient moves off of the sensor pad, the monitor makes an audible and visual output to alert nearby care givers. This alarm can be disabled only by someone possessing the magnetic key 240, thus preventing inadvertent or intentional resetting of the unit and defeating of the alarm function by a resident or patient. Accordingly, only a care giver can shut off the monitor; a resident is unable to do so.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A patient monitor with a magnetic disarming circuit, comprising:

an alarm housing having an alarm output and a magnetic key switch surface pad;

an alarm circuit disposed within said alarm housing and including a magnetic key reset switch in proximity to said magnetic key switch surface pad;

a power connector for connection to a power supply through a power cord;

a reset button;

a patient pressure pad electrically connected to said alarm housing; and a connector for bringing said patient pressure pad into electronic communication with said alarm circuit;

wherein the alarm circuit is armed when a load is placed on said patient pressure pad, and wherein said alarm circuit is disarmed when a magnet is placed onto said magnetic key switch surface pad for a sufficient period of time, thereby tripping said magnetic key reset switch to selectively deactivate said alarm circuit.

* * * * *